United States Patent [19]

Painter

[11] 4,014,407

[45] Mar. 29, 1977

[54] CONCEALED SECURITY TRANSPORT SYSTEM

[75] Inventor: Perry J. Painter, Mabelton, Ga.

[73] Assignee: The Citizens and Southern National Bank, Atlanta, Ga.

[22] Filed: July 7, 1975

[21] Appl. No.: 593,435

[52] U.S. Cl. ..... 186/1 C; 186/17

[51] Int. Cl.[2] ..... E04H 3/04

[58] Field of Search ..... 186/1 R, 1 C, 14, 17, 186/18, 26, 33; 104/173, 177; 214/11 R

[56] References Cited

UNITED STATES PATENTS

| | | | |
|---|---|---|---|
| 1,050,008 | 1/1913 | DeHart | 186/14 |
| 2,044,391 | 6/1936 | Lindsay | 186/1 C |
| 2,900,046 | 8/1959 | Bailey | 186/1 C |

*Primary Examiner*—Trygve M. Blix
*Assistant Examiner*—Reinhard J. Eisenzopf
*Attorney, Agent, or Firm*—Patrick F. Henry

[57] ABSTRACT

Drive-in banks, some large service stations and similar operations use cashiers windows located on small islands at a remote place from the central building. A concealed transport system is located below the floor of the main building and employs a carrier box mounted on rollers which operate on flanged tracks mounted on the sides of a small tunnel which extends beneath the respective casher's booths each of which has an access door in the floor to reach the tunnel. A nylon cable attached at its opposite ends to the carrier extends around a large drive wheel pulley inside the main building and across various idler pulleys in the ends of the tunnel.

9 Claims, 5 Drawing Figures

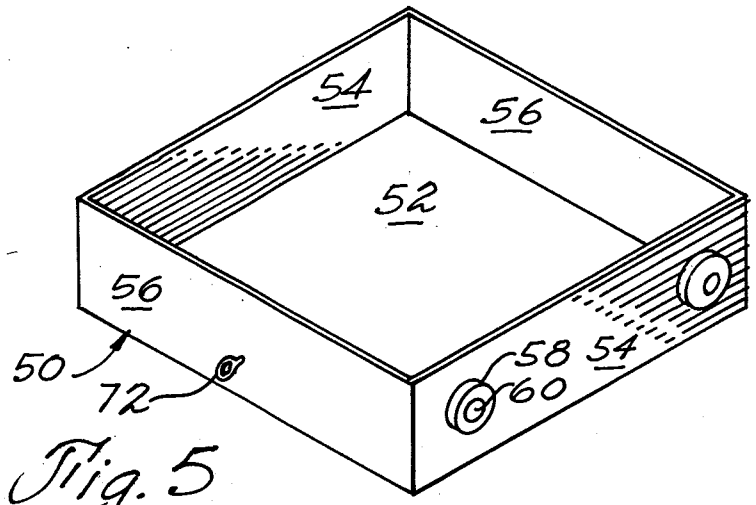
Fig. 5
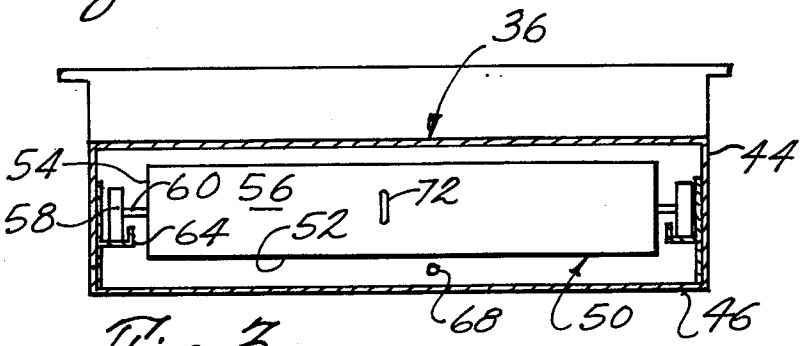
Fig. 3
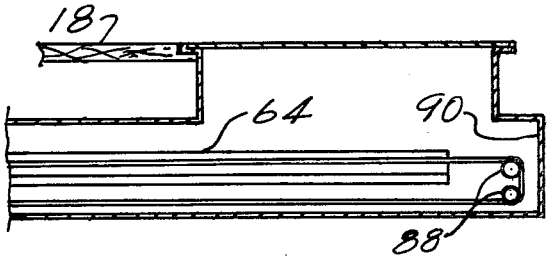
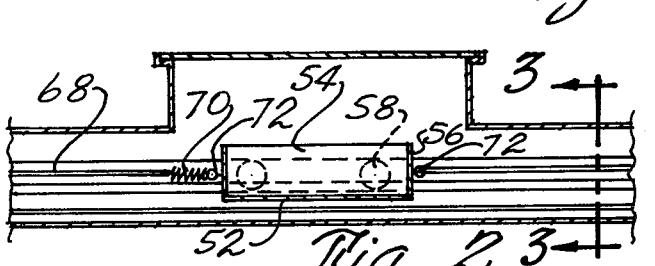
Fig. 2
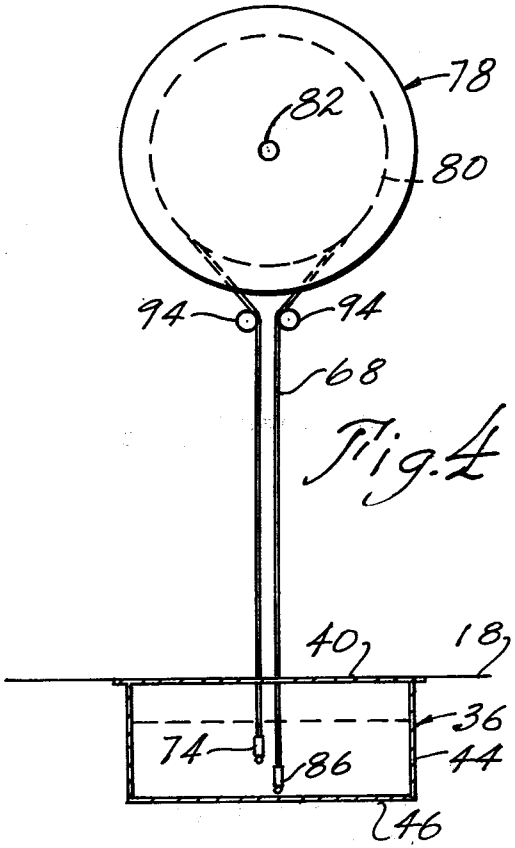
Fig. 4
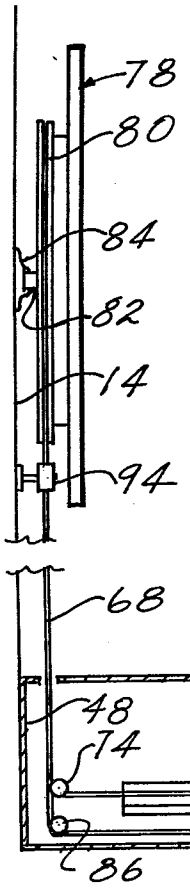

CONCEALED SECURITY TRANSPORT SYSTEM

BACKGROUND OF THE INVENTION

1. Field of the Invention

Cable propulsion systems and the like especially reciprocating cable propulsion systems of the sort used in store services. Also conveyors and power driven transport devices particularly single reciprocating conveying devices.

2. Description of the Prior Art

The use of cable and rope propelled transport systems, such as a "clothesline" pulley arrangement, is quite old in the art and the delivery between remote stations of a carrier by means of a rope and pulley system is well known. However, such systems are basically very simple and lack the required design for use in modern day banking and similar facilities for transporting valuables between the main bank building and remote cashier's islands. For this purpose, there are many highly sophisticated electronic and similar systems which have been designed for installation in drive-in banks and the like but these have in many instances proved to be too expensive in installation and service for what is actually accomplished and also such systems have proved to be too complex and the electronic and other aspects of the system have caused the tellers and bank employees trouble for the rather simple act of transporting some money or papers from a close building to the island without hand carrying it and without visible transport. Obviously, prior art cable systems, such as "clothesline" systems, which utilize containers or buckets or the like on ropes and pulleys, would not be satisfactory for use in a modern day drive-in bank establishment. It is necessary for security and other reasons to conceal the system below the floor or ground level and in doing so of course many problems are created in that the system is not visible and must be operated above the transport from inside the main building. Therefore, such a system must be simple and dependable but yet must be concealed and sufficiently operable to perform the work. Problems with other prior art systems include the means of propelling the carrier back and forth and how it will be located and operated for simplicity. The present arrangement solves all of the problems involved in such systems and makes it possible to transport valuables in a concealed and dependable way.

SUMMARY OF THE INVENTION

A security transport system located in a tunnel between a main bank building and remote cashier's islands comprising an open carrier container having rollers on the opposite sides thereof, track means mounted on the sides of the tunnels on which said rollers operate, said tunnel being substantially straight and elongated and a cable means having one end fastened to one end of the carrier and the other end fastened to the other end of the carrier forming a continuous cable which moves around pulleys to a large drive wheel rotatably mounted inside the main building.

An object of this invention is to provide a means of transporting valuables and money through a tunnel from a main building to remote islands and to return same through the operation of a large drive means inside the main building.

An additional object of this invention is found in the arrangement of the means of driving the carrier inside the tunnel which comprises a large drive wheel around which passes a continuous cable member which transports the carrier from one end of the tunnel to the other.

An additional object of the invention is found in the arrangement of the carrier which may be in the form of a large open drawer having small rollers on each side thereof.

Another object of this invention resides in the arrangement of the combination of the carrier, cable operating means, drive wheel and tunnel access doors whereby the system is completely dependable.

Other and further objects and advantages of my invention will become apparent upon reading the following specification taken in conjunction with the accompanying drawings.

BRIEF DESCRIPTION OF THE DRAWINGS

FIG. 2 is a vertical cross-sectional view taken substantially along lines 2—2 in FIG. 1.

FIG. 3 is a transverse vertical cross-sectional view taken substantially along lines 3—3 in FIG. 2.

FIG. 4 is an enlarged elevation view of the drive wheel detail.

FIG. 5 is a perspective view of the carrier.

DESCRIPTION OF A PREFERRED EMBODIMENT

Figure 1:
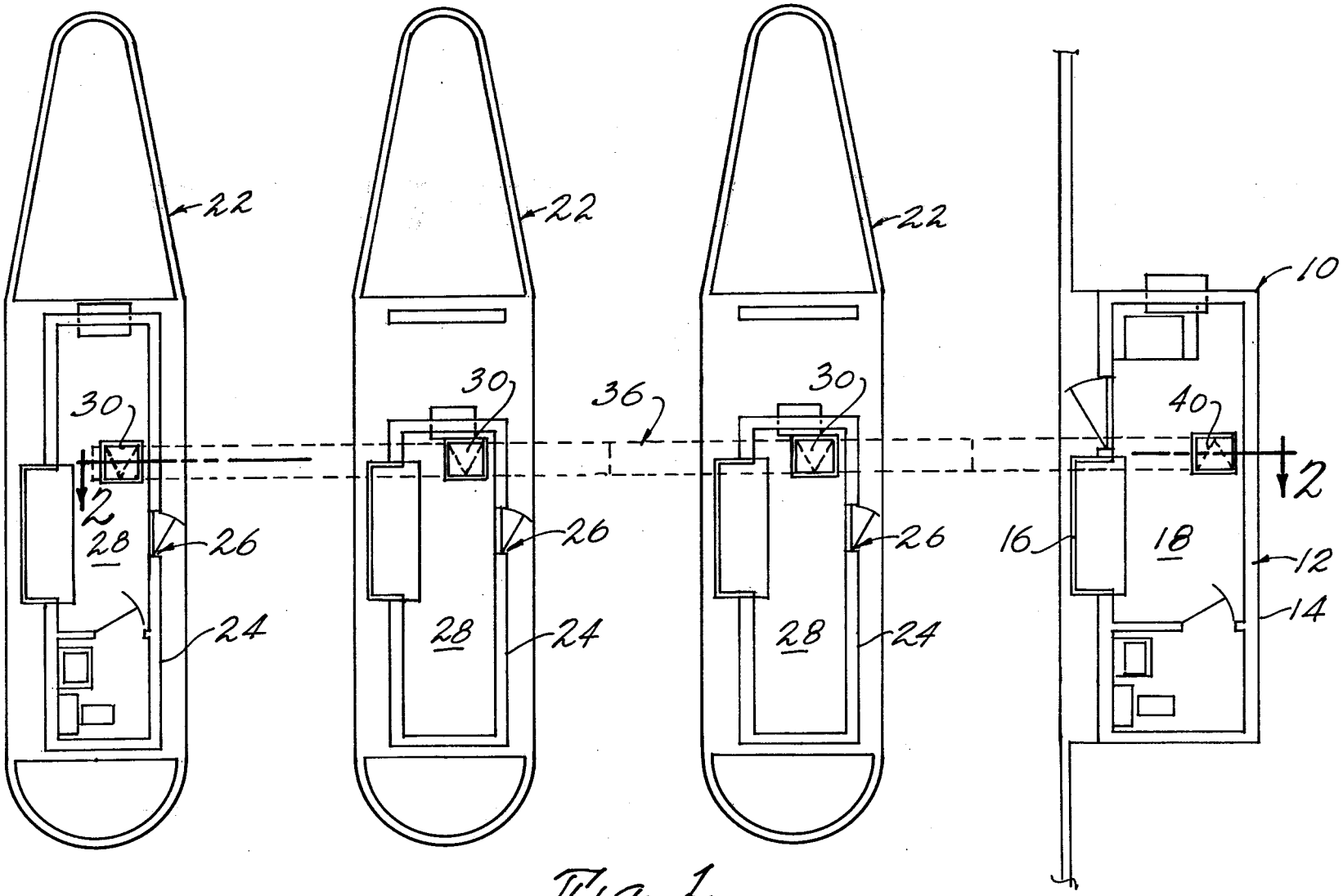
FIG. 1 is a top plan view of a typical drive-in bank illustrating the present system installed between the remote islands.

In FIG. 1 there is shown a drive-in bank establishment designated generally by reference numeral 10 and comprising a substantially flat ground area on which is located a typical drive-in main bank building 12 having vertical walls 14 in which is located the first drive-in window No. 1 designated by reference numeral 16. An elongated, substantially straight but small tunnel has been built beneath the floor 18 of the building and across beneath the floors, underneath the ground or concrete asphalt surface 20, if necessary, leading to the respective remote drive-in booths 22 in which are located the additional drive-in windows No. 2, No. 3 and No. 4. Each drive-in booth is the usual small enclosure having walls 24 and provided with the conventional security system of windows and cash transfer designated by reference numeral 26 and which per se does not form any part of the present invention. Each floor 28 of each of the booths 22 is provided with an access door 30 which may be made from any suitable material such as wood, steel, fiber board or any combination thereof. Each door 30 is hinged on one side to be lifted by the cashier inside the booth 22 to provide access to the elongated tunnel 36 which has been constructed from the access door 40 inside the main bank building 12 beneath the ground surface and the respective booths 22.

As seen in FIG. 2, the tunnel 36 comprises side tunnel walls 44, a bottom 46 and end walls 48. If desired the tunnel walls 44, bottom 46 and end walls 48 may be constructed from lightweight metal plates which is welded together or otherwise attached in place and concealed beneath the main floor 18 of the building 12.

Located within the tunnel 36 for operation therein is a money and valuables carrier 50 which resembles a large drawer and has a bottom 52, sides 54 and ends 56. Small nylon rollers 58 mounted on roller shafts 60 are attached in spaced pairs on opposite sides 54 of the carrier 50. Running all along the tunnel on opposite sides 44 thereof is a flanged steel track 64 mounted substantially straight throughout the tunnel 36 and having the carrier 50 mounted thereon with the rollers 58 on the track 64. A nylon cable 68 has one end attached to a tension spring 70 which is attached to an eyebolt 72 on the front end 56 of carrier 50 and the cable extends around an idler pulley 74 up the wall 14 of the main bank building and around a drive wheel arrangement designated generally by reference numeral 78 and comprising a large circular drive wheel which is approximately 2 feet in diameter having a slightly smaller drive pulley 80 attached to the back side thereof and mounted on a pulley shaft 82 attached to the wall 14 by means of a bracket 84. The cable 68 passes around the drive pulley 80 and thence back across another transfer pulley 86 along the bottom of the tunnel 36 beneath the carrier 50 thence around a pair of transfer pulleys 88 in the end 90 of tunnel 36 and thence back to the carrier 50 being attached to the rear end 56 thereof by means of an eyebolt 72. The cable 68 is held in place on pulley 80 by means of a pair of guide pulleys 94 mounted in spaced aligned relationship below the drive wheel 78 so as to prevent the disengagement or accidental dislodgement of the cable 68 from the pulley 80 and to make it easy to drive the cable around and by means of the drive wheel 78.

While I have shown and described a particular embodiment of this invention together with a suggested mode of operation this is by way of illustration only and does not constitute any sort of restriction on the scope of the invention since various alterations, changes, deviations, eliminations, revisions, and departures may be made in the embodiment shown without avoiding the scope of the invention as defined only by proper interpretation of the appended claims.

What is claimed is:

1. In a concealed security transport system for drive-in banks or the like which have remote cashiers windows: a main building and a plurality of remote stations spaced substantially in a row from said main building, a concealed passage extending substantially in a horizontal elongated straight line from said main building beneath the floor thereof across and beneath the surface in each of said remote stations, an access door in said main building and said remote stations, an open money and valuables carrier container supported for movement in said passage, and having support wheels on opposite sides thereof, elongated straight rails having said support wheels thereon, a flexible drive member having one end attached to said carrier and extending in an endless manner therefrom and having the other end attached to the opposite and rear end of said carrier, a drive pulley mounted within said main building, said flexible drive member being around said drive pulley for operation thereby, and guide means for said flexible drive member on opposite ends of said passage.

2. The device in claim 1 wherein said guide means comprises guide pulleys and said flexible drive member is directed about said guide pulleys on opposite ends of said passage, and there being a pair of guide pulleys beneath said main drive pulley.

3. The device claimed in claim 1 wherein there is a drive wheel mounted on said drive pulley and covering the face thereof, said drive wheel being manually operable to transport said carrier.

4. The device claimed in claim 3 wherein said guide means comprises guide pulleys and said flexible drive member is directed about said guide pulleys on opposite ends of said tunnel, and there being a pair of guide pulleys beneath said main drive pulley.

5. In a concealed security transport system for drive-in banks or the like which have remote cashiers windows: a main building and a plurality of remote stations spaced substantially in a row from said main building, a concealed passage extending substantially in an elongated, horizontal straight line from said main building beneath the floor thereof across and beneath the surface in each of said remote stations, an access door in said main building and each of said remote stations, a vertical space beneath said respective doors leading to said passage, an open money and valuables carrier container movably supported for operation in said passage to pass beneath each station whereby there is access to said open container, elongated, horizontal support means in said passage and having said carrier supported for horizontal straight line movement thereon, said container having opposite ends, a flexible drive member having one end attached to said one end of said carrier container and extending in an endless manner therefrom and having the other end attached to the other end of said carrier, support wheels on said carrier container operable on said elongated, horizontal support means, and guide means for said flexible drive member on opposite ends of said passage.

6. The device in claim 5: a drive pulley mounted within said main building, said flexible drive member being around said drive pulley for operation thereby.

7. The device claimed in claim 6 wherein said drive pulley has a drive wheel mounted thereon and covering the face thereof, said drive wheel being manually operable to transport said carrier.

8. The device claimed in claim 5 wherein said open container has sides and said support wheels are mounted in spaced pairs on each side of said container.

9. The device claimed in claim 8 wherein said flexible drive member is a cable, a large diameter drive pulley mounted within said main building and said endless cable extending around said drive pulley for operation thereby, a pair of small guide pulleys each respectively engaging a different portion of said cable to retain same on said drive pulley.

* * * * *